US007842886B2

(12) United States Patent
Kobayashi et al.

(10) Patent No.: US 7,842,886 B2
(45) Date of Patent: Nov. 30, 2010

(54) TRANSMISSION CABLE

(75) Inventors: Kazuyoshi Kobayashi, Tochigi (JP); Kenichirou Hanamura, Tochigi (JP); Tomomitsu Hori, Tochigi (JP)

(73) Assignees: Sony Corporation, Tokyo (JP); Sony Chemical & Information Device Corporation, Tokyo (JP)

( * ) Notice: Subject to any disclaimer, the term of this patent is extended or adjusted under 35 U.S.C. 154(b) by 244 days.

(21) Appl. No.: 12/161,131

(22) PCT Filed: Nov. 1, 2006

(86) PCT No.: PCT/JP2006/321836

§ 371 (c)(1),
(2), (4) Date: Aug. 19, 2008

(87) PCT Pub. No.: WO2007/083429

PCT Pub. Date: Jul. 26, 2007

(65) Prior Publication Data

US 2009/0000804 A1 Jan. 1, 2009

(30) Foreign Application Priority Data

Jan. 17, 2006 (JP) ..... 2006-009293

(51) Int. Cl.
*H01B 7/00* (2006.01)

(52) U.S. Cl. ..... 174/117 R; 174/117 F; 174/117 FF

(58) Field of Classification Search ..... 174/110 R, 174/113 R, 117 R, 117 F, 117 FF, 36
See application file for complete search history.

(56) References Cited

U.S. PATENT DOCUMENTS

| | | | | |
|---|---|---|---|---|
| 4,845,311 | A * | 7/1989 | Schreiber et al. | 174/36 |
| 6,320,133 | B1 * | 11/2001 | Rimmer | 174/117 F |
| 6,459,041 | B1 * | 10/2002 | Achari et al. | 174/117 F |
| 6,523,252 | B1 * | 2/2003 | Lipponen | 29/828 |
| 6,541,711 | B1 * | 4/2003 | Dube et al. | 174/261 |
| 7,196,273 | B2 * | 3/2007 | Tanaka et al. | 174/117 R |
| 7,429,702 | B2 * | 9/2008 | Kobayashi et al. | 174/117 FF |
| 7,737,359 | B2 * | 6/2010 | Sexton et al. | 174/36 |
| 2001/0054512 | A1 * | 12/2001 | Belau et al. | 174/262 |

FOREIGN PATENT DOCUMENTS

| | | |
|---|---|---|
| JP | 07-099397 | 4/1995 |
| JP | 11-162267 | 6/1999 |
| JP | 2002-117726 | 4/2002 |
| WO | 2006/003732 | 1/2006 |

* cited by examiner

*Primary Examiner*—William H Mayo, III
(74) *Attorney, Agent, or Firm*—K & L Gates LLP

(57) ABSTRACT

A transmission cable includes multiple signal lines formed on one side of an insulation layer and a ground line between the signal lines. The ground line is electrically connected to a shield layer formed on a back surface side of the insulation layer and to a noise suppressing layer having a high electric resistance value than the shield layer via a metal bump embedded and formed in the insulation layer. The noise suppressing layer has a function to suppress an unwanted emission and/or a noise and has a function as an etching barrier layer serving as an etching stopper in a step for forming the metal bump. Thus, the transmission cable can suppress an increase of an electric resistance and a connection resistance between the ground line and the shield layer.

25 Claims, 3 Drawing Sheets

TRANSMISSION CABLE

CROSS REFERENCE TO RELATED APPLICATIONS

The present application claims priority to Japanese Patent Application No. 2006-009293 filed on Jan. 17, 2008, the entire contents of which is being incorporated herein by reference.

BACKGROUND

The present disclosure relates to a transmission cable having an interlayer connection with a bump.

In various network systems and the like, data and the like are transmitted via a transmission cable (network cable), and a flat transmission cable allowing easy handling of wiring has been developed. The flat transmission cable is made by performing a patterning processing to form a signal line using a method similar to that used for a so-called flexible wiring board, and is advantageous in reducing irregularities when the flat transmission cable is wired at an arbitrary location such as under floor furnishings and the like.

In the mean time, a broadband era has necessitated a fast and large-capacity transmission, and thus the improvements in transmission cables are also desired. For example, the transmission cable made by merely forming a signal line involves problems such as malfunctions caused by noise, interference of signals, and the like.

Under such circumstances, a transmission cable has been suggested in which a ground line is arranged between signal lines to be electrically connected to a shield layer formed via an insulation layer (for example, see, Japanese Patent Application Publication No. H11-162267, Japanese Patent Application Publication No. 2002-117726, and the like). Specifically, Japanese Patent Application Publication No. H11-162267 discloses a flat cable in which a shield pattern and a shield layer are electrically connected with an electrically-conductive bump formed by an electrically-conductive resin paste. Japanese Patent Application Publication No. 2002-117726 discloses a sheet flexible cable in which a sheet shield conductor and a sheet insulator are laminated, wherein a shield ground line among multiple conducting wires arranged parallel in the insulator is connected to the shield conductor via an electrically-conductive through-hole and the like. It should be noted that a similar structure can be seen in a circuit board structure (see, for example, Japanese Patent Application Publication No. 7-99397 and the like).

Prior art transmission cables, however, have disadvantages that an electric resistance of the conductive paste is high and that a connection resistance with a copper foil making up a ground line is also high. If these electric resistance and connection resistance are high in the transmission cable, the ground line will not function sufficiently, and accordingly, a noise and an interference between signal lines cannot be sufficiently suppressed. This becomes a major obstacle in a signal transmission speedup and the like.

A problem of increasing a manufacturing cost arises in a case where a manufacturing method is employed that involves forming an electrically-conductive bump using a conductive paste and pressing the electrically-conductive bump into an insulator layer to penetrate therethrough. For example, Japanese Patent Application Publication No. H11-162267 discloses a technology to form an electrically-conductive bump according to a stamp method and the like that involves pressing an electrically-conductive composition (paste), contained in a casing, onto a predetermined position of a stainless plate and pushing out the electrically-conductive composition from holes of a mask. Such a method requires a dedicated apparatus such as a stamp apparatus, and furthermore requires, e.g., to perform a heat hardening processing upon repeatedly performing a printing and drying processing at an identical position, thus resulting in complicated steps.

SUMMARY

The present disclosure is in view of such circumstances, and it is the object of the present invention to provide a highly reliable transmission cable. In an embodiment a transmission cable includes a bump easily formed for a highly reliable connection using a manufacturing process for an ordinary wiring circuit board. The transmission cable can simplify a manufacturing process and reduce a manufacturing cost, can suppress an increase of an electrical resistance and a connection resistance between a ground line and a shield line, and is capable of fast transfer and large-capacity transfer while sufficiently suppressing a noise and an interference between signal lines.

In an embodiment, the transmission cable includes an insulation layer, a plurality of signal lines formed on one side of the insulation layer, a ground line formed between the signal lines, a shield layer formed on a back surface side of the insulation layer, a metal bump formed and embedded in the insulation layer, a part mounting area formed to mount one or more parts realizing predefined functions on one side or both sides of the insulation layer, and a wiring extending from the part mounting area, wherein the ground line is electrically connected to the shield layer via the metal bump.

In the embodiment as described above, the transmission cable, the metal bump connecting as an interlayer connection between the ground line and the shield layer is a metal bump formed by etching a copper foil and the like. Thus, the transmission cable has a low electric resistance because the metal bump itself is made of metal. In the transmission cable, connections between the metal bump and the ground line and between the metal bump and the shield layer are connections between metals. Thus, a connection resistance therebetween is suppressed to be a low value.

In the transmission cable according to the embodiment as described above, the electric resistance of the bump itself for the interlayer connection and the connection resistances between the ground line and the bump and between the shield layer and the bump can be held low. Thus, the ground line effectively functions as a shield, and an interference between the signal lines and an induction of a noise can be reliably suppressed.

Regarding a manufacturing of the transmission cable, the metal bump is formed by etching a copper foil and the like. The etching is a general purpose technology in a wiring patterning and the like. By using the etching technology, the metal bump can be easily formed. An etching apparatus for manufacturing a wiring circuit board can be utilized as it is, and for example, a special apparatus for bump formation such as a stamp apparatus is ot needed. The transmission cable according to the embodiment has the shield layer made of the copper foil and the like, and can thus be manufactured utilizing a manufacturing process for an ordinary wiring circuit board that often uses the copper foil and the like as the shield layer. Accordingly, in the transmission cable according to the embodiment, an existing manufacturing process can be utilized to easily form the highly reliable metal bump, so that a manufacturing process can be simplified and a manufacturing cost can be reduced.

The transmission cable according to an embodiment includes a part mounting area formed to mount one or more parts, realizing predefined functions, on one side or both sides of the insulation layer and also has a wiring extending from the part mounting area. Thus, in addition to a data transmission function, the transmission cable can be structured as a multi-functional transmission cable realizing functions with the mounted parts.

In the transmission cable according to an embodiment, the signal lines may be made as the differential signal lines. Thus, in addition to the above-described advantages, the transmission cable can enjoy numerous advantages such as high resistance against noise, a larger margin for signal fade, low voltage operation capability, and reduction of EMI (Electromagnetic Interference), compared with a single-end signal line.

In the transmission cable according to an embodiment, the pitch of the metal bump is shorter a wavelength of the transmission signal flowing in the signal line. Thus, in addition to the above-described advantages, the transmission cable can enjoy advantages that an interference between the signal lines can be sufficiently suppressed and the shield effect is improved.

The transmission cable according to an embodiment includes a material made of polyimide or liquid crystal polymer as the insulation layer. Thus, in addition to the above-described advantages, the transmission cable can enjoy advantages such as not needing an adhesive agent and the like when the transmission cable is connected with a metal.

In the transmission cable according an embodiment, the metallic bond may connect the metal bump with the shield layer and/or with the signal lines and the ground line. Thus, in addition to the above-described advantages, the transmission cable can enjoy an advantage that a reliable conduction is achieved with an extremely low resistance.

The transmission cable according an embodiment achieving the above-described object may have the multiple signal lines on one side of the insulation layer, the ground lines formed between the multiple signal lines, and a noise suppressing layer having a high electric resistance value than the shield layer, wherein the ground lines are electrically connected to the shield layer and the noise suppressing layer formed on a back surface side of the insulation layer via the metal bump formed and embedded in the insulation layer, and wherein the noise suppressing layer has a function to suppress an unwanted emission and/or a noise and a function as an etching barrier layer serving as an etching stopper in a step for forming the metal bump.

In the transmission cable according to the embodiment described above, the metal bump connecting as the interlayer connection between the ground line and the shield layer and between the ground line and the noise suppressing layer is the metal bump formed by etching the copper foil and the like. In the transmission cable according to the embodiment, the metal bump itself is made of a metal, and accordingly, has a low electric resistance. Furthermore, in the transmission cable according to the embodiment, a connection between the ground line and the metal bump, a connection between the shield layer and the metal bump, and a connection between the noise suppressing layer and the metal bump are all connections established by contact of metals. Accordingly, the connection resistances therebetween are suppressed to be a low value.

As described above, in the transmission cable according to the embodiment, the electric resistance of the bump itself connecting between the layers, a connection resistance between the ground line and the metal bump, a connection resistance between the shield layer and the metal bump, and a connection resistance between the noise suppressing layer and the metal bump are held low, and accordingly, the ground line effectively functions as a shield, so that an interference between the signal lines and an induction of a noise are reliably suppressed. Specifically, the transmission cable according to the embodiment is arranged with the noise suppressing layer, and thus, can suppress the unwanted emission and the noise and can reliably suppress the interference between the signal lines and the induction of the noise.

Furthermore, the transmission cable does not use a large amount of expensive material for the shield layer, but uses an inexpensive material such as the copper foil and the like for the shield layer. The transmission cable is arranged with the noise suppressing layer, and achieves a high suppressing effect of the unwanted emission and the noise at extremely low cost.

The noise suppressing layer can be formed between the back surface side of the insulation layer and the shield layer to be in contact with the insulation layer and the shield layer. The noise suppressing layer is preferably a layer including Ni. This is because the layer including Ni can be used as the etching barrier layer when the transmission cable according to the embodiment is manufactured.

In the transmission cable according to the embodiment, the metal bump is preferably connected via metallic bond with the shield layer, the noise suppressing layer, and/or the signal lines and the ground lines, so that a reliable conduction is achieved with extremely low resistance.

In the transmission cable according to the embodiment, the insulation layers, the shield layers, and the noise suppressing layers may be formed on both sides of the signal lines and the ground lines, and the ground line may be electrically connected, at both sides of the ground line, to each of the shield layers and the noise suppressing layers via the metal bump. Thus, the transmission cable according to the embodiment has a completely shielded structure that completely shields surroundings of the signal lines, and can be used as the super-high frequency transmission cable.

The embodiment can suppress an increase of the electrical resistance and the connection resistance between the ground line and the shield, and can sufficiently suppress the noise and the interference between the signal lines. Thus, the highly reliable transmission cable is provided that is capable of fast transfer and large-capacity transfer. Thus, a normal wiring circuit board process can be utilized to easily form the highly reliable bump for connection, so that a manufacturing process can be simplified and a manufacturing cost can be reduced.

Additional features and advantages are described herein, and will be apparent from, the following Detailed Description and the figures.

DETAILED DESCRIPTION

An embodiment will be hereinafter described in detail with reference to figures.

The present embodiment is a transmission cable used for data transfer and the like in various network systems and the like. Especially, a manufacturing process of the transmission cable can be simplified by using a manufacturing process for an ordinary wiring circuit board, and a manufacturing cost thereof can be reduced. The transmission cable sufficiently suppresses a noise and an interference between signal lines, and thus is capable of fast transfer and large-capacity transfer and is highly reliable.

Figure 1:
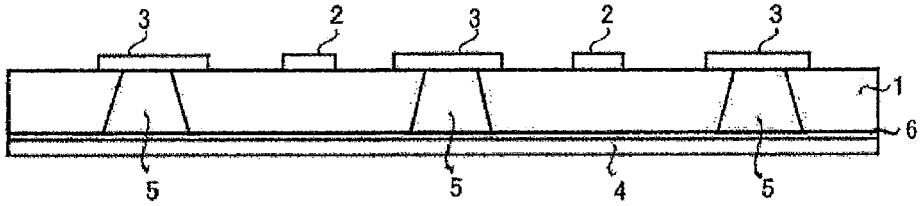
FIG. 1 is a schematic cross-sectional view of an essential portion to show an example of the transmission cable according to an embodiment.

FIG. 1 shows a structure of the transmission cable shown as an embodiment. The transmission cable has signal lines 2 and ground lines 2 formed on one surface of an insulation layer 1 serving as a substrate, namely, on an upper surface here. The signal line 2 is used for transfer of various signals such as data transfer and the like, and plays a central role in this transmission cable.

A malfunction and the like caused by an induced noise is a problem in the transmission cable. In a case where multiple sets (two sets) of the signal lines 2 are formed just like those of the present embodiment, a mutual interference between the signal lines 2 becomes problematic. Thus, this transmission cable has ground lines 3 formed between these signal lines 2, so that the mutual interference is solved.

However, the ground line 3 arranged independently has little effect, and the ground line 3 must be grounded by some means. Thus, this transmission cable has a shield layer 4, made of a copper foil and the like, formed on a back surface of the insulation layer 1. This transmission cable also has metal bumps 5 penetrating the insulation layer 1, and the ground lines 3 and the shield layer 4 are electrically connected via the metal bumps 5. The shield layer 4 is formed substantially all over the back surface of the insulation layer 1, and any portion thereof is grounded. Thus, the transmission cable has the ground lines 3 electrically connected to the shield layer 4 via the metal bumps 5, so that the ground lines 3 are grounded.

The transmission cable is preferably arranged with a noise suppressing layer 6, and the ground lines 3 are preferably electrically connected to not only the shield layer 4 but also the noise suppressing layer 6 via the metal bumps 5. The noise suppressing layer 6 is made of a material including Ni, for example, Ni and the like. The noise suppressing layer 6 has a higher electric resistance value than the shield layer 4, and is formed between the back surface side of the insulation layer 1 and the shield layer 4 to be in contact with the insulation layer 1 and the shield layer 4.

Theoretically, transmission cables in general should not be affected by an unwanted emission and a noise in a case, e.g., where the transmission cables have a completely shielded structure completely shielding the periphery of a signal line or are coaxial cables of infinite length and the like. However, an actual transmission cable is of a finite length, and thus cannot be completely free from an influence of the unwanted emission and the noise caused by an influence of a signal reflection and the like at terminals.

The transmission cable according to the present embodiment has a noise suppressing layer 6 having a function to suppress the unwanted emission and/or the noise in order to solve such problems. The noise suppressing layer 6 should have a higher electric resistance value than the shield layer 4. Thus, the transmission cable is arranged with the noise suppressing layer 6 having a higher electric resistance value than the shield layer 4. Accordingly, even if the shield layer 4 is used that is made of a material having a low electric resistance value such as a copper foil and the like, the unwanted emission and the noise can be effectively suppressed without deteriorating an electromagnetic shield function of the shield layer 4, so that a mutual interference between the signal lines 2 and an induction of noise can be reliably suppressed. It should be noted that the noise suppressing layer 6 has not only a function to suppress the unwanted emission and/or the noise, but also a function as an etching barrier layer serving as an etching stopper in a step of forming the metal bump 5 as described later.

The metal bump 5 is formed by, for example, etching the copper foil, and the entirety thereof consists of metal material. Accordingly, the metal bump 5 has far less electric resistance than a conductive paste and the like made of a resin having electrically conductive particles dispersed therein. A connection between the ground line 3 and the metal bump 5, a connection between the shield layer 4 and the metal bump 5, and a connection between the noise suppressing layer 6 and the metal bump 5 are all connections established by contact of metals, and a connection resistance therebetween is also low.

Thus, in the transmission cable structured as shown in FIG. 1, the ground line 3 effectively functions as a shield between the signal lines 2, and reliably suppresses the mutual interference between the signal lines 2 and the induction of the noise, so that the transmission cable becomes a high frequency transmission cable suitable for fast transfer and large-capacity transfer.

The transmission cable as described above is manufactured according to a series of steps, as described below.

Figure 2:
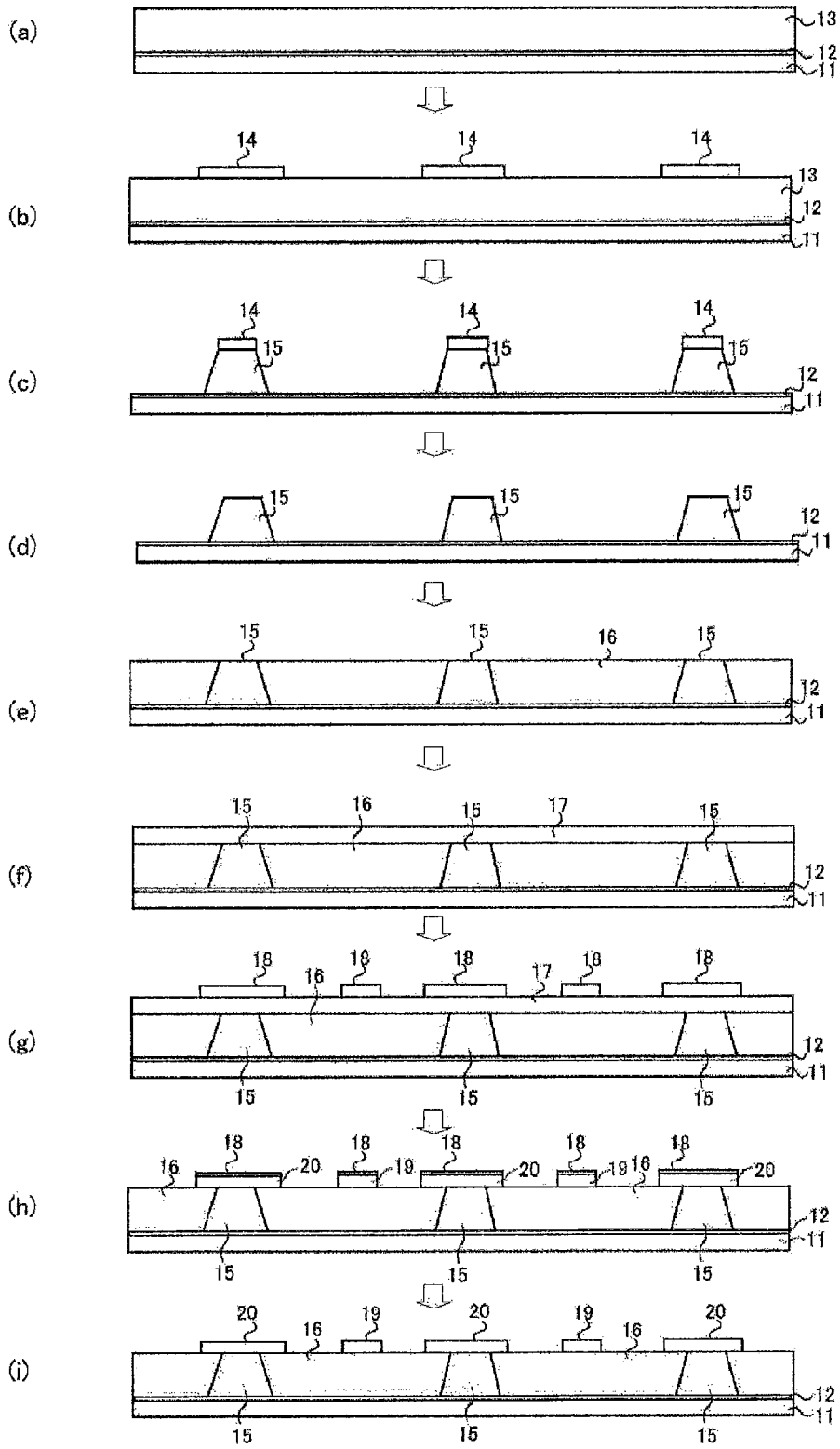
FIG. 2 is a schematic cross-sectional view of the essential portion to show a manufacturing process of the transmission cable according to the embodiment, (a) is a figure showing a cladding material, (b) is a figure showing a resist film formation step, (c) is a figure showing a metal bump formation step, (d) is a figure showing a resist film removal step, (e) is a figure showing an insulation layer formation step, (f) is a figure showing a copper foil pressure-bonding step for forming wirings, (g) is a figure showing a resist formation step for forming wiring patterns, (h) is a figure showing a wiring pattern etching step, and (i) is a figure showing a resist film removal step.

In order to manufacture the transmission cable, a cladding material is prepared, as shown in FIG. 2(*a*), that is made by laminating an etching barrier layer 12 and a bump formation copper foil 13, for making the metal bump 5, on a copper foil 11 corresponding to the shield layer 4. The etching barrier layer 12 is made of material including Ni, such as Ni and the like, has an etching selectivity with respect to the bump formation copper foil 13, and serves as an etching stopper when the bump formation copper foil 13 is etched. It should be noted that the etching barrier layer 12 is not removed but remains as the noise suppressing layer 6, as described above.

Then, the bump formation copper foil 13 is etched, so that the metal bump 15 is formed. This etching of the bump formation copper foil 13 is preferably performed by a combination of an acid etching liquid and an alkali etching liquid. That is, in a manufacturing of the transmission cable, a resist film 14 serving as a mask is formed on the bump formation copper foil 13, and thereafter, the acid etching liquid such as cupric chloride is sprayed, as shown in FIG. 2(*b*). Thus, the bump formation copper foil 13 is etched, but an etching depth caused by this acid etching liquid is made shallower than a thickness of the bump formation copper foil 13, and the etching is performed within such range that the etching barrier layer 12 is not exposed.

Subsequently, in the manufacturing of the transmission cable, after washing (rising), a remaining portion of the bump formation copper foil 13 is etched with the alkaline etching liquid such as ammonium hydroxide and the like. The alkaline etching liquid hardly affects Ni making up the etching barrier layer 12. Accordingly, the etching barrier layer 12 functions as a stopper against the etching by the alkaline etching liquid. It should be noted that a pH of the alkaline etching liquid at this moment is preferably 8.0 or less. In the manufacturing of the transmission cable, by making the pH of the alkaline etching liquid 8.0 or less, the bump formation copper foil 13 can be etched relatively faster without affecting the etching barrier layer 12. As hereinabove described, the metal bumps 15 is formed as shown in FIG. 2 (*c*).

Furthermore, in the manufacturing of the transmission cable, after the metal bumps 15 are formed, the resist film 14 remaining on the metal bumps 15 is removed as shown in FIG. 2 (*d*), spaces between the metal bumps 15 are filled with the insulation layer 16 as shown in FIG. 2 (*e*), and a wiring formation copper foil 17 is formed overlappingly on an apical surface of the metal bumps 15 as shown in FIG. 2(*f*).

The insulation layer 16 is formed by filling a thermoplastic resin and the like such as polyimide, liquid crystal polymer, and the like. The insulation layer 16 is preferably formed to an extent that the insulation layer 16 is slightly lower than a height of the metal bump 15 so that a contact between the metal bumps 15 and the wiring formation copper foil 17 in ensured. It should be noted that the transmission cable uses the liquid crystal polymer as the insulation layer 16, and thus, an adhesive and the like are not necessary to connect the insulation layer 16 with a metal, and a low hygroscopic property of the liquid crystal polymer achieves superior dimensional stability. Furthermore, the liquid crystal polymer has a low dielectric constant, thus achieving to reduce a transmission loss.

In the manufacturing of the transmission cable, the wiring formation copper foil 17 is placed overlappingly and unified. At this moment, for example, the wiring formation copper foil 17 is sandwiched between stainless boards, and a press machine applies thereto a predefined pressure, thereby pressure-bonding the wiring formation copper foil 17. Thus, the wiring formation copper foil 17 slightly crushes the apical surfaces of the metal bumps 15, and reliably comes in contact with the metal bumps 15 and conducts electricity to the metal bumps 15. An anisotropic conductive adhesive agent film and the like may be arranged between the metal bumps 15 and the wiring formation copper foil 17 to achieve an electrical conduction between the metal bumps 15 and the wiring formation copper foil 17. In the manufacturing of the transmission cable, when the wiring formation copper foil 17 is placed overlappingly and unified, a thermocompression bonding enables metallic bond connection between a signal line and the wiring formation copper foil 17 serving as a ground line, thus achieving reliable conduction. Similarly, in the manufacturing of the transmission cable, the thermocompression bonding enables metallic bond connection between the metal bumps 15 and each of the copper foil 11 and the etching barrier layer 12 serving as the shield layer 4 and the noise suppressing layer 6, respectively, thus achieving reliable conduction.

Subsequently, in the manufacturing of the transmission cable, the wiring formation copper foil 17 is etched so that a wiring pattern, specifically the signal line and the ground line, is formed.

To form the wiring pattern, a resist layer 18 is formed according to a pattern of the signal line and the ground line as shown in FIG. 2(*g*). The resist layer 18 is formed with a normal photolithography technology. For example, a resist material is formed on all over the wiring formation copper foil 17 and is thereafter exposed and developed so that the resist layer 18 remains in the predefined pattern.

In the manufacturing of the transmission cable, an etching is performed using the resist layer 18 as an etching mask, and a patterning is performed to make the signal lines 19 and the ground lines 20 as shown in FIG. 2(*h*). The etching process here is similar to an etching process for forming a wiring pattern in a manufacturing process of normal wiring circuit boards. Last, in the manufacturing of the transmission cable, the resist layer 18 remaining on the signal lines 19 and the ground lines 20 is removed as shown in FIG. 2(*i*). Thus, the transmission cable as previously shown in FIG. 1 is completed.

In the manufacturing method as described above, the metal bumps 15 are formed by etching the bump formation copper foil 13. The etching is a general-purpose technology for patterning of wiring and the like. Accordingly, by utilizing, for example, an existing manufacturing apparatus such as an etching bath and the like and a photolithography technology and the like, the metal bumps 15 can be easily formed without using a special apparatus and technology. The metal bumps 15 are laminated as the cladding material on the copper foil 11, and thus have good electrical connection with the copper foil 11 serving as the shield layer and with the etching barrier layer 12 serving as the noise suppressing layer 6. Furthermore, the metal bumps 15 are pressure-bonded with the wiring formation copper foil 17, and thus have good electrical connection with the ground line 20.

In a case of forming the multiple metal bumps 15, it is preferable to set a pitch of the metal bumps 15 shorter than a wavelength λ, expressed by Formula (I) below, of the transmission signal flowing in the signal line. It should be noted that c is the light speed ($3\times10^8$m), $\epsilon_r$ is a dielectric constant of the insulation layer 16, and f is a transmission frequency. For example, in a case where a signal of the transmission frequency 50 GHz is transmitted, it is preferable to set the pitch of the metal bump 15 equal to or less than 0.5 mm. Thus, by making the pitch of the metal bump 15 shorter than the wavelength λ of the transmission signal, the transmission cable can sufficiently suppress an interference between the signal lines and improve a shielding effect.

Formula 1

$$\lambda = \frac{c}{\sqrt{\varepsilon_r}\, f} \tag{1}$$

As hereinabove described, the transmission cable shown as the embodiment of the present invention is formed with the noise suppressing layer 6 made of a material including Ni, and thus, even where the shield layer 4 made of the copper foil and the like is used, the transmission cable suppresses the unwanted emission and the noise and reliably suppresses the mutual interference between the signal lines 2 and the induction of the noise without diminishing an electromagnetic shield function of the shield layer 4. Especially, the transmission cable has the shield layer 4 made of the copper foil and the like, and thus, a manufacturing process for a normal wiring circuit board can be utilized that often use the copper foil and the like as the shield layer. Thus, by using the existing manufacturing process, the highly reliable metal bump 5 can be formed easily in the transmission cable, the manufacturing process can be simplified, and a manufacturing cost can be reduced. Furthermore, an increase in the electric resistance and the connection resistance between the ground lines 3 and the shield layer 4 can be suppressed in the transmission cable. Thus, the noise and the mutual interference between the signal lines can be sufficiently suppressed, and the transmission cable can achieve the fast transfer and the large-capacity transfer with high reliability. Furthermore, the transmission cable does not use a large amount of expensive material such as Ni and the like for the shield layer, but uses an inexpensive material such as the copper foil and the like for the shield layer 4. The transmission cable is arranged with the noise suppressing layer 6 at extremely low cost, and achieves a high suppressing effect of the unwanted emission and the noise.

The present embodiment is not limited to the embodiment as described above. For example, although it is assumed that the signal lines 2 and the ground lines 3 are formed on one surface of the insulation layer 1 serving as the substrate in the embodiment as described above, the embodiment also allows the shield layers to be arranged on both sides of the insulation layer 1 to completely shield the surrounding of each of the signal lines.

Figure 3:
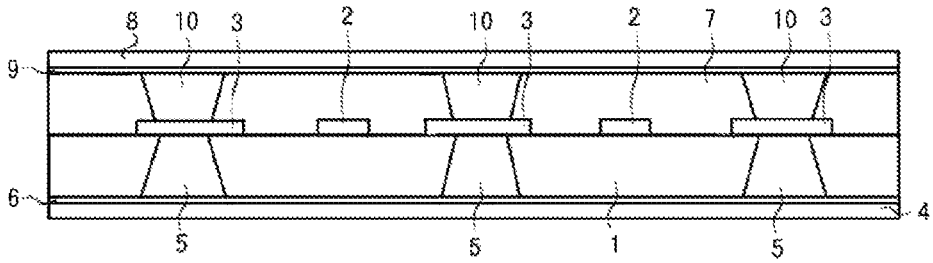
FIG. 3 is a schematic cross-sectional view of the essential portion to shown an example of a completely shielded type transmission cable according to the embodiment.

Specifically, the transmission cable having the shield layers on the both sides as described above is structured, for example, as shown in FIG. 3. That is, the transmission cable having the shield layers on the both sides has the same structure, with respect to below the signal lines 2 and the ground lines 3, as an example of the transmission cable previously shown in FIG. 1. That is, the transmission cable has: the signal lines 2 and the ground lines 3 arranged on top of the insulation layer 1; the shield layer 4 and the noise suppressing layer 6 arranged on a back side (a lower side) of the insulation layer 1; and the shield layer 4 and the noise suppressing layer 6 electrically connected to the ground lines 3 via the metal bumps 5.

In the example shown in FIG. 3, the same structure as described above is also formed on top of the signal lines 2 and the ground lines 3. That is, the transmission cable in FIG. 3 has a second insulation layer 7 covering the signal lines 2 and the ground lines 3, and has a second shield layer 8 and a second noise suppressing layer 9 formed on top of the second insulation layer 7. The second shield layer 8 and the second noise suppressing layer 9 are electrically connected to the ground line 3 via metal bumps 10 that are the same as the metal bumps 5.

Figure 4:
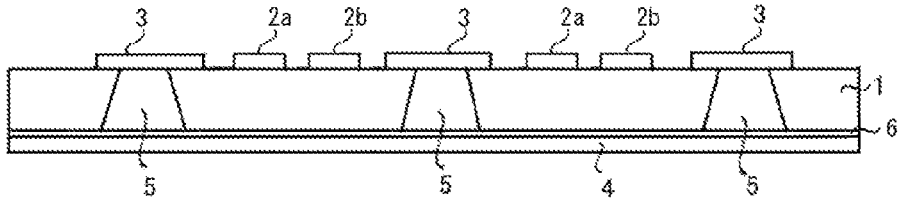
FIG. 4 is a schematic cross-sectional view of the essential portion to show an example of the transmission cable according to the embodiment, and is a figure showing an example of the transmission cable having a structure shown in FIG. 1 to which differential signal lines are applied.
Figure 5:
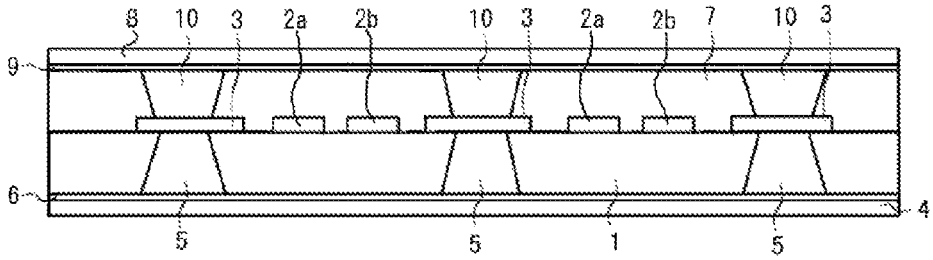
FIG. 5 is a schematic cross-sectional view of the essential portion to show an example of the completely shielded type transmission cable according to the embodiment, and is a figure showing an example of the transmission cable having a structure shown in FIG. 3 to which the differential signal lines are applied.

In addition to the process previously shown in FIG. 2, the manufacturing of the transmission cable as shown in FIG. 3 should involve a step for placing the cladding material formed with the metal bumps overlappingly on a surface formed with the signal lines 2 and the ground lines 3. That is, in the manufacturing of the transmission cable of FIG. 3, the cladding material formed with the insulation layer as shown in FIG. 2 (*e*) is disposed upside down so that the metal bump 15 is on a lower side, and tips of the metal bumps 15 are butted against and pressure-bonded with the ground lines 3. Thus, a transmission cable is formed in which the signal lines 2 and the ground lines 3 are sandwiched between the shield layers 4, 8 and the noise suppressing layers 6, 9 on the upper and lower sides, respectively, and in which the shield layers 4, 8 and the noise suppressing layers 6, 9 are connected to the ground layer 3 via the metal bumps 5, 10, respectively. The transmission cable has a three-layer structure, which is a completely shielded structure completely shielding the surroundings of the signal lines 2, and thus, can be used as a superhigh frequency transmission cable. It should be noted that the transmission cable can be further multi-layered to achieve the transmission cable capable of superfast large-capacity transmission In the above-described embodiment, a case is described where one set of the signal line 2 is arranged between the ground lines 3, but the present embodiment may also be applied to a case where a differential signal is transmitted via two sets of signal lines. That is, in a case where the transmission cable shown in FIG. 1 is made for the differential signal lines, two sets of the signal lines 2*a*, 2*b* should be arranged corresponding to the ground lines 3 as shown in FIG. 4. In a case where the transmission cable shown in FIG. 3 is made for the differential signal lines, two sets of the signal lines 2*a*, 2*b* should be arranged corresponding to the ground lines 3 as shown in FIG. 5. Therefore, compared with a single-end signal line, the transmission cable arranged with the differential signal lines enjoys numerous advantages such as high resistance against noise, a larger margin for signal fade, low voltage operation capability, and reduction of EMI (Electromagnetic Interference).

The transmission cable only for data transfer is described in the above-described embodiment, but one or more parts and wirings in a form of chip and the like realizing predefined functions may also be mounted on the transmission cable because the transmission cable is structured the same as the normal wiring circuit board. That is, the transmission cable may have a part mounting area, not shown in the figures, formed on either or both sides of the insulation layer 1, 7 to mount one or more parts realizing predefined functions, and wirings extending from the part mounting area may be formed. Especially, this kind of the transmission cable is flat shaped, and is thus preferred to be mounted in the inside of electronic devices such as cellular telephone and the like required to be made smaller, and for example, the transmission cable may mount parts such as a power source module for liquid crystal display. Therefore, the transmission cable is structured the same as the normal wiring circuit board, and can be structured as a multi-functional transmission cable realizing functions with mounted parts in addition to data transmission function, thus greatly contributing to miniaturization of the electronic devices having the above-described transmission cable.

In this kind of the transmission cable, a width of wirings can be made narrower compared with a so-called through-hole circuit board. With the through-hole circuit board, a through-hole is perforated on the circuit board and is thereafter plated with a copper foil and the like, and the plating adheres not only to the inside of the through-hole but also on a wiring copper foil. Thus, the through-hole circuit board tends to result in a thick overall thickness and to create variation in the thickness. Accordingly, the through-hole circuit board requires the width of wirings to be made wider and has a problem that it is difficult to form a fine pattern on the through-hole circuit board. On the other hand, the transmission cable is formed with the shield layer 4 and the like made of the copper foil and the like having a previously defined thickness, and has the metal bumps 5 embedded to penetrate the insulation layer 1, and thus, the transmission cable does not result in problems such as am unnecessarily thick thickness and a variation in the thickness, and can easily control the width of wirings and can easily form a fine pattern. Therefore, the transmission cable is highly effective for the use for only data transmission, and is also highly effective as multi-functional transmission cable mounted with one or more parts achieving predefined functions as described above.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A transmission cable comprising:

an insulation layer;

a plurality of signal lines formed on one side of the insulation layer;

a ground line formed between the signal lines;

a shield layer formed on a back surface side of the insulation layer;

a metal bump formed and embedded in the insulation layer;

a part mounting area formed to mount one or more parts realizing predefined functions on one side or both sides of the insulation layer; and a wiring extending from the part mounting area, wherein the ground line is electrically connected to the shield layer via the metal bump.

2. The transmission cable according to claim 1 further comprising:

a noise suppressing layer having a higher electric resistance value than the shield layer, wherein the ground line is electrically connected to the shield layer and the noise suppressing layer, and wherein the noise suppressing layer has a function to suppress an unwanted emission and/or a noise and a function as an etching barrier layer serving as an etching stopper in a step for forming the metal bump.

3. The transmission cable according to claim 2, wherein the noise suppressing layer is formed between a back surface side of the insulation layer and the shield layer to be in contact with the insulation layer and the shield layer.

4. The transmission cable according to claim 3, wherein the insulation layers and the shield layers are formed on both sides of the signal lines and the ground line, and wherein the ground line is electrically connected, at both sides of the ground line, to each of the shield layers via the metal bump.

5. The transmission cable according to claim 2, wherein the noise suppressing layer is a layer including Ni.

6. The transmission cable according to claim 5, wherein the insulation layers and the shield layers are formed on both sides of the signal lines and the ground line, and wherein the ground line is electrically connected, at both sides of the ground line, to each of the shield layers via the metal bump.

7. The transmission cable according to claim 2, wherein the signal lines are differential signal lines.

8. The transmission cable according to claim 7, wherein the insulation layers and the shield layers are formed on both sides of the signal lines and the ground line, and wherein the ground line is electrically connected, at both sides of the ground line, to each of the shield layers via the metal bump.

9. The transmission cable according to claim 2, wherein a pitch of the metal bump is shorter than a wavelength of a transmission signal flowing in the signal lines.

10. The transmission cable according to claims 9, wherein the insulation layers and the shield layers are formed on both sides of the signal lines and the ground line, and wherein the ground line is electrically connected, at both sides of the ground line, to each of the shield layers via the metal bump.

11. The transmission cable according to claim 2, wherein the pitch of the metal bump is 0.5 mm or less.

12. The transmission cable according to claim 11, wherein the insulation layers and the shield layers are formed on both sides of the signal lines and the ground line, and wherein the ground line is electrically connected, at both sides of the ground line, to each of the shield layers via the metal bump.

13. The transmission cable according to claim 2, wherein the insulation layer is made of polyimide or liquid crystal polymer.

14. The transmission cable according to claim 13, wherein the insulation layers and the shield layers are formed on both sides of the signal lines and the ground line, and wherein the ground line is electrically connected, at both sides of the ground line, to each of the shield layers via the metal bump.

15. The transmission cable according to claim 2, wherein a metallic bond connects the metal bump with the shield layer and the noise suppressing layer and/or with the signal lines and the ground line.

16. The transmission cable according to claim 15, wherein the insulation layers and the shield layers are formed on both sides of the signal lines and the ground line, and wherein the ground line is electrically connected, at both sides of the ground line, to each of the shield layers via the metal bump.

17. The transmission cable according to claim 2, wherein the insulation layers and the shield layers are formed on both sides of the signal lines and the ground line, and wherein the ground line is electrically connected, at both sides of the ground line, to each of the shield layers via the metal bump.

18. The transmission cable according to claim 1, wherein the signal lines are differential signal lines.

19. The transmission cable according to claim 18, wherein the insulation layers and the shield layers are formed on both sides of the signal lines and the ground line, and wherein the ground line is electrically connected, at both sides of the ground line, to each of the shield layers via the metal bump.

20. The transmission cable according to claim 1, wherein a pitch of the metal bump is shorter than a wavelength of a transmission signal flowing in the signal lines.

21. The transmission cable according to claim 20, wherein the insulation layers and the shield layers are formed on both sides of the signal lines and the ground line, and wherein the ground line is electrically connected, at both sides of the ground line, to each of the shield layers via the metal bump.

22. The transmission cable according to claim 1, wherein the insulation layer is made of polyimide or liquid crystal polymer.

23. The transmission cable according to claim 22, wherein the insulation layers and the shield layers are formed on both sides of the signal lines and the ground line, and wherein the ground line is electrically connected, at both sides of the ground line, to each of the shield layers via the metal bump.

24. The transmission cable according to claim 1, wherein a metallic bond connects the metal bump with the shield layer and/or with the signal lines and the ground line.

25. The transmission cable according to claim 1, wherein the insulation layers and the shield layers are formed on both sides of the signal lines and the ground line, and wherein the ground line is electrically connected, at both sides of the ground line, to each of the shield layers via the metal bump.

* * * * *